United States Patent [19]

Hill

[11] 4,348,872

[45] Sep. 14, 1982

[54] BULK ICE BIN

[76] Inventor: Kenneth W. Hill, R.R. 5, Mexico, Mo. 65265

[21] Appl. No.: 226,193

[22] Filed: Jan. 19, 1981

[51] Int. Cl.[3] ..... F25C 5/18

[52] U.S. Cl. ..... 62/459; 62/529; 52/194

[58] Field of Search ..... 62/344, 459, 529; 98/55; 52/192, 194, 197

[56] References Cited

U.S. PATENT DOCUMENTS

| | | | |
|---|---|---|---|
| 940,170 | 11/1909 | Lockwood | 52/192 |
| 1,242,012 | 10/1917 | Lynch | 52/197 |
| 2,990,036 | 6/1961 | Dubie | 52/194 |
| 3,067,591 | 12/1962 | Lingle | 62/344 |
| 3,277,666 | 10/1966 | Simmons | 62/344 X |
| 3,742,664 | 7/1973 | Reding | 52/197 X |
| 3,913,343 | 10/1975 | Rowland et al. | 62/344 X |
| 3,918,266 | 11/1975 | Gindy et al. | 62/344 X |

FOREIGN PATENT DOCUMENTS

| | | | |
|---|---|---|---|
| 150817 | 9/1920 | United Kingdom | 52/197 |

*Primary Examiner*—William Tapolcai, Jr.
*Attorney, Agent, or Firm*—Gravely, Lieder & Woodruff

[57] ABSTRACT

A storage bin for bulk ice has upper and lower sections that completely enclose a space in which ice cubes are stored. These ice cubes are produced by an ice making machine and are delivered to the ice bin by a conveyor which is inclined upwardly away from the ice making machine. One of the walls on the upper section of the ice bin is inclined to accommodate the inclination of the conveyor and this wall has an opening through which the ice cubes are discharged into the enclosed space. The lower section of the bin has an opening through which the ice cubes are withdrawn for bagging, while the upper section has another opening that provides access to the interior of the bin for breaking up ice jams. Both of these openings are normally closed by doors. Refrigeration equipment extracts heat from the enclosed space of the bin, and the water line that leads to the ice making machine passes through the space so that the water is precooled, thus rendering the ice making machine considerably more efficient.

6 Claims, 5 Drawing Figures

BULK ICE BIN

BACKGROUND OF THE INVENTION

This invention relates in general to the production of bagged ice, and more particularly to equipment for storing ice cubes prior to bagging.

On a commercial basis ice is produced in relatively large quantities by bulk ice machines. These machines, however, have no capacity for storing the ice or bagging it, and consequently additional equipment is necessary in the form of bulk ice bins and bagging machines. The ice bins of course store the ice derived from the bulk ice making machine and allow it to be withdrawn slowly for bagging in the bagging machine.

Most ice bins for small and medium size commercial ice plants are nothing more than adaptations of farm equipment. For example, some are derived from the beds of farm wagons, others are essentially spreaders for fertilizer, while still others are mere corn cribs. Irrespective of their derivation, conventional ice bins are quite expensive and add significantly to the capitalization required for an ice plant. Moreover, many are open on top and not insulated, and therefore they are not well suited for warm room bagging.

Aside from the foregoing, the capacity of a bulk ice machine to a large measure depends on the temperature of the water that is fed to the machine. To increase the capacity of their machines, many operators of small and medium size ice plants have installed precooling units in the water line leading to their machines. These precoolers are separate refrigeration systems and are expensive in their own right. They consequently add still more to the capital required for the plants in which they are used and furthermore are expensive to operate.

SUMMARY OF THE INVENTION

One of the principal objects of the present invention is to provide a bulk ice storage bin capable of storing ice cubes produced by a bulk ice making machine so that the ice can be subsequently bagged under warm room bagging conditions. Another object is to provide a machine of the type stated which is well insulated and closed at its top for storing ice for an extended time prior to bagging. A further object is to provide a bulk ice bin of the type stated that is configured to accommodate the transfer of ice from the bulk ice machine. An additional object is to provide an ice bin of the type stated which precools the water for the bulk ice machine so as to increase the capacity of the machine. Still another object is to provide an ice bin of the type stated that is inexpensive to manufacture. These and other objects and advantages will become apparent hereinafter.

The present invention is embodied in an apparatus including a housing having walls that enclose a space in which ice cubes are stored. One of the walls is inclined to accommodate a conveyor which discharges ice cubes through an opening in the inclined wall and into the enclosed space. One of the walls has an opening near the bottom of the enclosed space for withdrawing cubes from the bin and one of the walls also has an opening near the top of the enclosed space for gaining access to the space. The invention also resides in the combination of an ice making machine, a storage bin, a conveyor for delivering ice from the machine to the bin, and a water line that supplies water to the machine. The water line passes through the interior of the bin to precool the water before it is delivered to the ice making machine. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur

DETAILED DESCRIPTION

Figure 1:
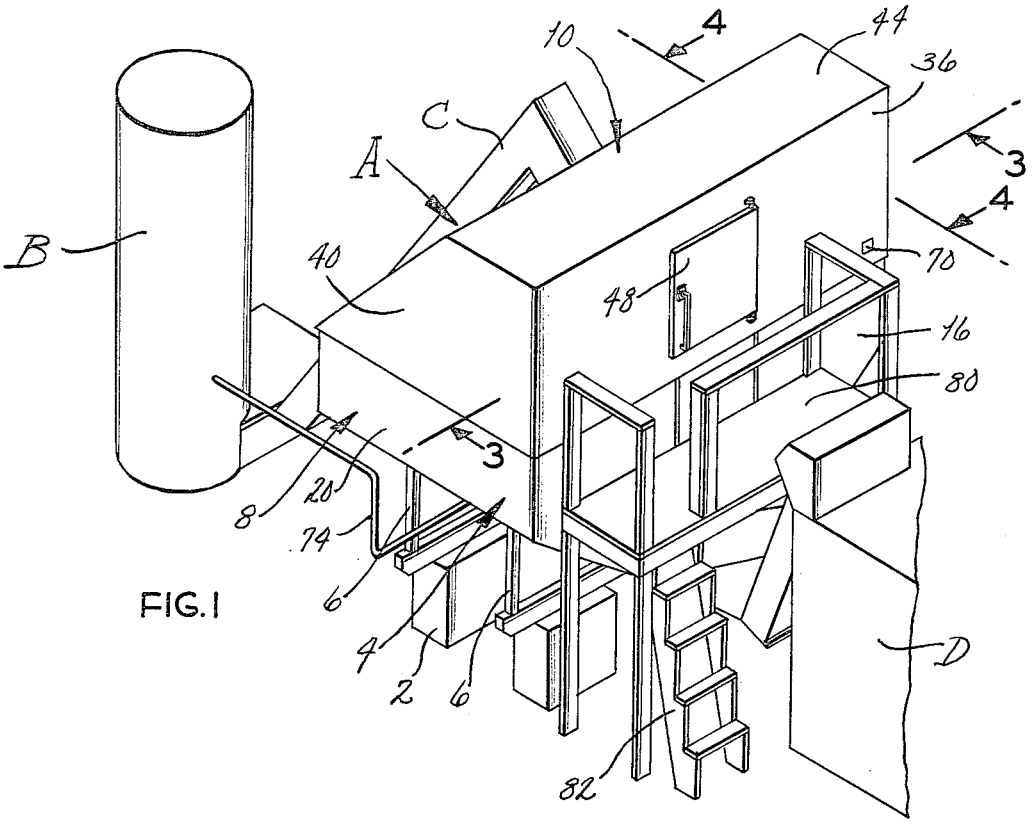
- FIG. 1 is a perspective view showing the left side and front of a bulk ice bin of the present invention as well as the ice machine and conveyor which are used in conjunction with that bin.
Figure 2:
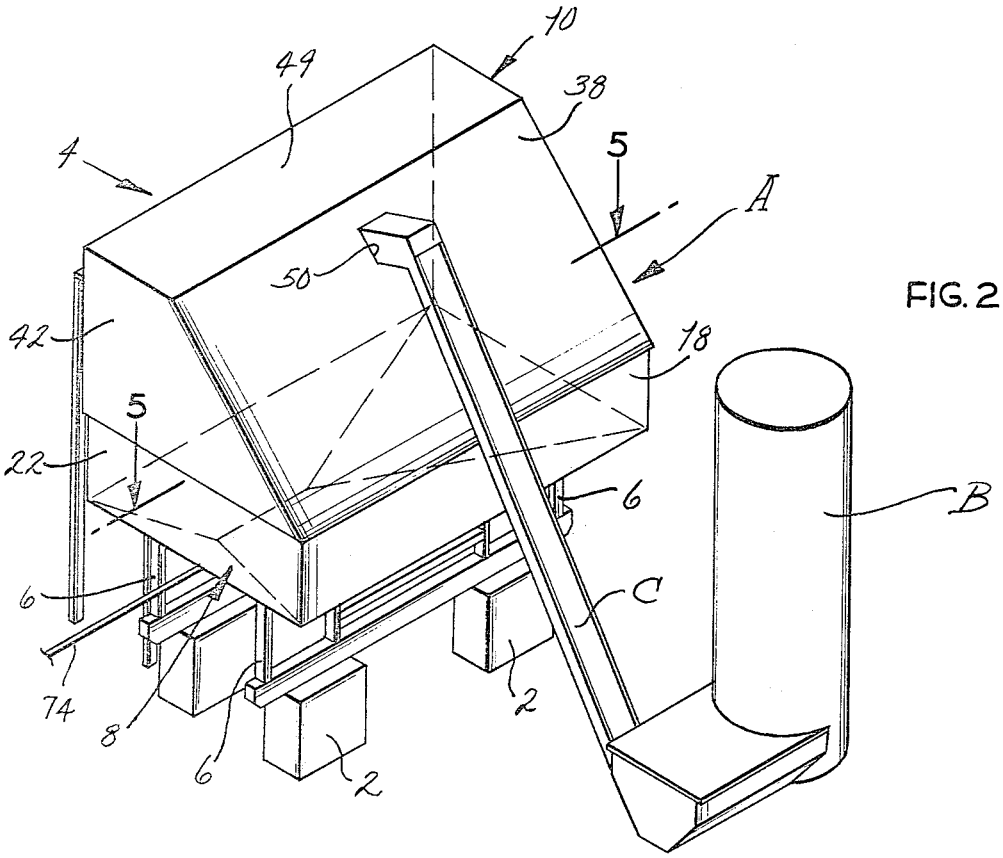
FIG. 2 is a perspective view showing the left side and rear of the ice bin as well as the conveyor and the ice making machine.

Referring now to the drawings, a bulk ice bin A (FIGS. 1 and 2) stores ice that is produced in cube form by a bulk ice machine B. The bin A and ice machine B are separate from each other, but are connected by auger-type conveyor C which delivers the ice cubes that are produced in the machine B to the bin A where they are stored for subsequent bagging. The bagging may be accomplished by manually removing the cubes from the bin, and placing them in bags, but the preferred procedure is to place a bagging machine D at the withdrawal door of the ice bin and allow the bagging machine D to fill the bags with a properly metered quality of ice cubes. The bin A is insulated and completely encloses the space in which the ice cubes are stored. It is thus well suited for warm room ice bagging.

The bulk ice bin A rests upon a foundation 2 and includes a housing 4 and supporting legs 6 which extend from the housing 4 to the foundation 2 for supporting the housing 4 in an upright position upon the foundation 2. The housing 4 in turn has lower and upper sections 8 and 10, respectively. The lower section 8 holds the large bulk of the ice cubes and is where the ice cubes are withdrawn. The legs 6 are furthermore secured to and project from the lower section 8. The upper section 10, on the other hand, closes the lower section 8 and accommodates the conveyor C which delivers the ice cubes to the bin A, the upper section having the entry at which the cubes are introduced into the bin A.

Figure 3:
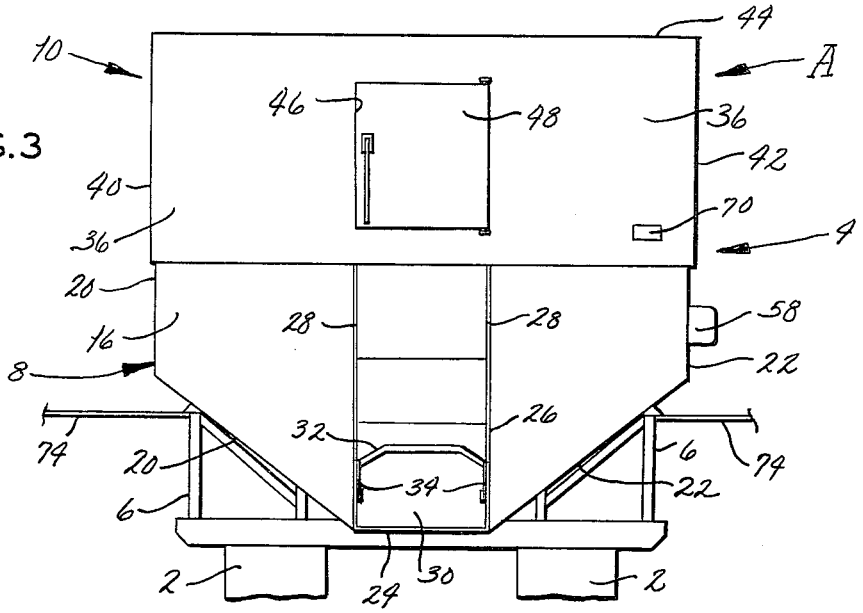
FIG. 3 is a front elevational view of the ice bin taken along line 3—3 of FIG. 1.

More specifically, the lower section 8 of the housing 4 possesses a generally rectangular configuration, it being composed of a front wall 16, a back wall 18, side walls 20 and 22, and a bottom wall 24, all of which are made of metal and are joined together along the margins, preferably by welds, to form water-tight joints. The two side walls 20 and 22 have vertical upper portions and inclined lower portions the latter of which converge towards and are joined to the bottom wall 24 which is inclined downwardly from the back wall 18. The vertical back wall 18 is joined at its sides to the vertical upper portions of the two side walls 20 and 22, whereas the inclined bottom wall 24 is joined along its sides to the lower portions of the side walls 20 and 22. The front wall 16, on the other hand, is vertical and planar throughout, and is joined along its side margins to the side margins of the two side walls 20 and 22 and along its bottom margin to the bottom wall 24. Owing to the inclination of the side walls 20 and 22, the side margins of the front wall 16 taper downwardly and converge toward the bottom wall 24. Adjacent to the bottom wall 24 where the lower margin of the front wall 16 is horizontal, the front wall 16 is provided with a rectangular opening 26 and tracks 28 (FIG. 3) along the sides of the opening 26, and these tracks receive the side edges of a door 30 such that the door 30 can slide upwardly and downwardly on them. Indeed, the tracks 28 extend the full height of the front wall 16 to enable the door 30, which is large enough to completely cover the opening 26, to slide upwardly to a position in which the opening 26 is entirely unobstructed. The tracks 28 also have a handle 32 connected to them such that it pivots across the front of the door 30, and this handle is connected to the door 30 by links 34 so that when the handle 32 is elevated, the door 30 rises.

The legs 6 that support the housing 4 on the foundation 2 are welded to the inclined portions of the side walls 18, 20 and to the bottom wall 24 and in effect cradle the lower portion 8 of the housing 4, presenting the opening 26 of the front wall 16 low enough to align with the collecting hopper of the bagging machine D. The lower section 8 may be constructed from the bed of a conventional farm wagon, but its steel walls 16, 18, 20 and 24 should be covered on their outwardly presented surfaces with a suitable heat insulating material such as $1\frac{1}{2}''$ cellular polystyrene slab material.

The upper section 10 of the housing 4 rests on the lower section 8 and completely encloses the upper end of the lower section 8. It includes a front wall 36, a rear wall 38, side walls 40 and 42, and a top wall 44, all of which is joined together to form a closure for the upper end of the lower section 8. The front wall 36, like the front wall 16 of the lower section is vertical, and indeed forms a continuation of the front wall 16 on the lower section. The front wall 36 also contains an opening 46 which is located directly above the opening 26 in the lower section 8. The opening 46 is normally closed by a door 48 that is supported on hinges so that it can be opened to provide access to the interior of the housing 4. The two side walls 40 and 42 are likewise in a vertical disposition and form upward continuations of the vertical upper portions for the side walls 20 and 22, respectively, on the lower section 8. The back wall 38, along its lower margins align with the back wall 18 of the lower section 8, but instead of being vertical, it is inclined forwardly toward the top wall 44. As a result the two side walls 20 and 22 have a trapezoidal configuration while the top wall 44 is considerably smaller than the upper end of the lower section 8. The front wall 36, the two side walls 40 and 42, and the back wall 38, may be constructed muck like conventional building walls with 2×4 studs and plates, plywood sheathing, and bat-type insulation between the studs.

The inclination of the back wall 38 for the upper section 10 corresponds generally to the inclination of the conveyor C leading from bulk ice making machine B. Centered in the inclined back wall 38 near the upper end of it is an opening 50 (FIG. 2) into which the ice cubes are discharged by the conveyor C. In this regard, the auger of the conveyor C is generally enclosed, as is the upper end of the conveyor C, all to maintain the ice cubes within the auger flight and insulate the cubes as much as possible from the surrounding atmosphere. The upper end of the conveyor C projects into the opening 50 and forms a good seal with it.

The walls 16, 18, 20, 22 and 24 of the lower section 8 and the walls 36, 38, 40, 42 and 44 of the upper section form a space 52 that is entirely enclosed. The conveyor C introduces ice cubes into the space 52 through the opening 50 in the inclined back wall 38, whereas ice cubes are withdrawn from the enclosed space through the opening 26 in the lower front wall 16. The opening 46 in the upper front wall 36 provides access to the enclosed space 52.

Figure 4:
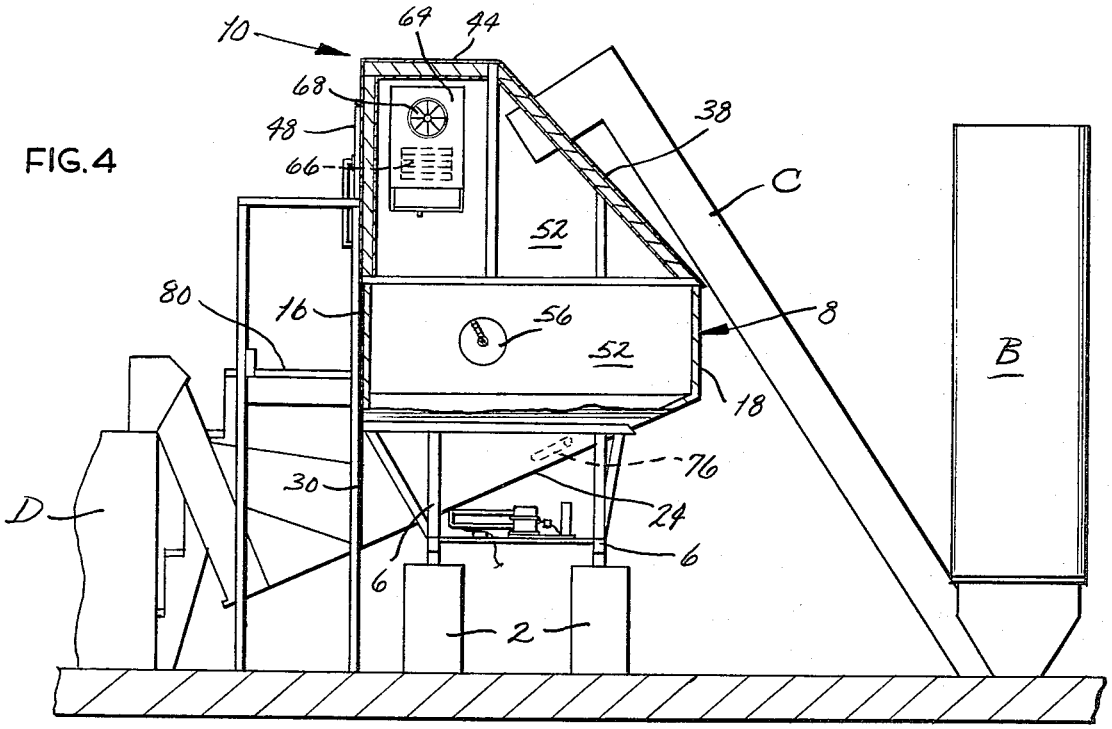
FIG. 4 is a sectional view of the ice bin taken along line 4—4 of FIG. 1.

Within the confines of the vertical portions of the back and side walls 18, 20 and 22 for the lower section 8 of the housing 4 is a distribution auger 56 (FIGS. 4 and 5) which is rotated by a gear motor 58 mounted on the side wall 20. The auger 56 extends between the side walls 20 and 22 and is parallel to the front and back walls 16 and 18. It spirals such that ice cubes which are caught within its flights are conveyed toward the side walls 20 and 22. In other words, the auger 56 has a left hand spiral on one side of its midpoint and a right hand spiral on the other side. As the ice cubes are deposited within the enclosed space 52 of the housing 4, they have a tendency to "cone", that is form a peak in the center of the housing 4. The auger 56, by driving the ice cubes toward the side walls 20 and 22 distributes the ice cubes more uniformly within the housing 4, thus enabling the housing 4 to hold a greater quantity of cubes. While the auger 56 in effect increases the capacity of the housing 4, it is not absolutely essential for the operation of the ice bin A.

The side wall 40 for the upper section 10 of the housing supports an evaporator unit 64 (FIG. 4) that is located entirely within the interior of the housing 4 and forms part of a refrigeration system. The evaporator unit 64 includes a coil 66 and a fan 68 located above the coil 66, the latter being adapted to draw air across the coil 66 and thereby cool the air. The fan 68 discharges the air along the underside of the top wall 44. In addition to the evaporator unit 64, the refrigeration system includes a thermostat 70 (FIG. 3) which senses the temperature of the air within the enclosed space 52 and causes the refrigeration system to energize so as to maintain the interior of the housing 4 at a predetermined temperature, preferably about 40° F.

Figure 5:
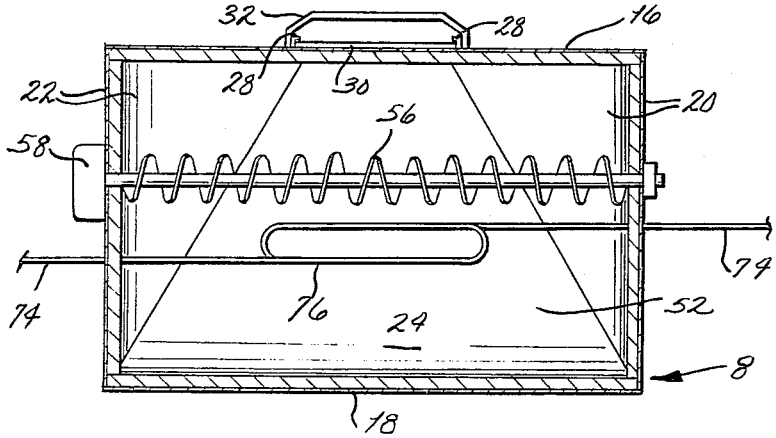
FIG. 5 is a sectional view of the ice bin taken along line 5—5 of FIG. 2.

Connected with the ice making machine B is a water line 74 that supplies the water from which the ice cubes are made. The water line passes into and out of the housing 4 and within the lower portion of the enclosed space 52 it assumes the configuration of a coil 76 (FIG. 5). Thus the coil 76 is practically always immersed in ice and as a consequence the water within it is cooled so that the water fed into the ice making machine B is at a lower temperature than would otherwise be the case.

Along the front of the housing 4 is an elevated platform 80 (FIG. 1) and stairs 82 which lead up to the platform 80, yet are offset to the side of the opening 46. The platform 80 is located above the opening 26, but below the opening 46. It thus provides convenient access to the the opening 46 and its door 48 without obscuring the opening 26. Consequently, the bagging machine D is easily placed in front of the opening 26 for accepting ice cubes that tumble from it.

OPERATION

In use, the bulk ice bin A stores ice cubes that are produced in the bulk ice machine B. More specifically, the machine B converts precooled water which is derived from the water supply line 74 into ice cubes which are deposited at the lower end of the conveyor C. By means of its auger, the conveyor C elevates the ice cubes over the inclined back wall 38 of the upper section 10 for the housing 4 and discharges them through the opening 50 in the back wall 18. The ice cubes drop downwardly and accumulate within the enclosed space 52, building up in a peaked configuration on the bottom wall 24 as well as on the inclined portions of the side walls 20 and 22. If enough ice is allowed to accumulate, its peak will eventually reach the distributing auger 56 which extends between the two side walls 20 and 22 of the lower section 8 for the housing 4. The ice at the top of the accumulation is caught within the auger flights and driven toward the side walls 20 and 22 and this of course tends to level the ice cubes within the space 52 so that they assume a more uniform distribution.

To withdraw ice cubes from the housing 4, the handle 32 is merely lifted and this of course causes the door 30 to slide upwardly on its tracks 28. As a consequence, the ice cubes tumble out of the opening 26. By placing the hopper of a bagging machine D below the opening, the ice is delivered to the bagging machine which meters it and deposits it within suitable bags. Sometimes the ice tends to bridge within the enclosed space 52 of the housing 4, meaning that the ice cubes jam together into a relatively solid mass which remains intact after the ice beneath it is withdrawn through the opening 26. This mass or "bridge" is easily broken into separate ice cubes merely by opening the door 48 in the upper portion of the housing 4 and striking the mass a few times with a blunt instrument. The ice cubes thereupon drop to the bottom of the space 52 where they can be withdrawn through the opening 26 for bagging.

The refrigeration system operating through the evaporator unit 64 maintains the enclosed space 52 at a temperature which preserves the ice for a substantial period of time, at least long enough for convenient warm room packing. A suitable temperature is 40° F.

Since the water that is used by the ice machine B passes through the coil 76 that is immersed within the ice cubes in the housing 4, that water is cooled to about 40° before it enters the ice making machine B. This improves the capacity of the ice making machine significantly. Even though the heat extracted from the water that passes through the housing melts some of the ice within the housing 4, a significant net gain is achieved. For example, precooling the water in this manner may melt 500 pounds of ice within the bin A during a single day's operation, but the ice machine B will produce an additional 2000 pounds during that same period, so that a net gain of 1500 pounds is achieved.

This invention is intended to cover all changes and modifications of the example of the invention herein chosen for purposes of the disclosure which do not constitute departures from the spirit and scope of the invention.

What is claimed is:

1. An apparatus for storing ice cubes, said apparatus comprising: a housing having a lower section and an upper section supported on the lower section, the lower section having a generally planar and vertical front wall provided with an opening that is located midway between its sides and along its bottom, the lower section also having a pair of side walls and a bottom wall all of which slope downwardly toward the opening in the front wall, so that ice which is directed into the lower section will gravitate toward the opening, the upper section having a generally planar and vertical front wall that aligns with and forms an upward continuation of the front wall on the lower section, the front wall of the upper section also having an opening that is located generally above the opening in the front wall of the lower section, the upper section also having side walls that extend upwardly from the side walls of the lower section, and a planar back wall that extends upwardly from the back of the lower section, with the back wall being inclined such that the top of the upper section is considerably smaller than the bottom of the upper section, the inclined back wall having an opening near its upper end, whereby an inclined conveyor may be placed over the inclined back wall to bring its discharge end into close proximity and alignment with the opening in the back wall; a lower door supported on the front wall of the lower section and normally closing the opening in that front wall; an upper door supported on the front wall of the upper section and normally closing the opening in that wall; and means attached to the lower section for supporting it in an upright position.

2. The apparatus according to claim 1 and further comprising means located within the space enclosed by the walls of the lower section for moving ice cubes from the center of the enclosed space toward the walls at the sides of the space so that the ice cubes deposited through the opening in the inclined back wall of the upper section do not accumulate as a cone within the space.

3. The apparatus according to claim 2 wherein the means located within the space comprises a distributing auger that is supported on the side walls of the lower section and extends horizontally through the space, the auger having a flight that moves ice cubes that are along it away from the center of the enclosed space.

4. The apparatus according to claim 1 and further comprising refrigerating means within the enclosed space for extracting heat from the space.

5. An apparatus according to claim 1 wherein the walls of the lower section are formed from metal that is covered with a heat insulating material.

6. An apparatus according to claim 1 and further comprising a platform located along the front wall of the lower section such that the upper door is above the platform and accessible from it and the lower door is beneath the platform.

* * * * *